United States Patent [19]

Kharazov et al.

[11] 4,109,219

[45] Aug. 22, 1978

[54] ELECTROMAGNETIC SWITCHING DEVICE

[76] Inventors: Konkordy Innokentievich Kharazov, ulitsa Valtera Ulbrinkhta 13/3, korpus 15, kv. 110; Gennady Viktorovich Netsvetaev, ulitsa Generala Karbysheva 1, kv. 62; Valery Ivanovich Trofimov, Yaroslavskoe shosse 8, korpus 1, kv. 159, all of Moscow, U.S.S.R.

[21] Appl. No.: 660,152

[22] Filed: Feb. 23, 1976

[51] Int. Cl.[2] ..... H01H 51/24

[52] U.S. Cl. ..... 335/78; 335/136; 335/183

[58] Field of Search ..... 335/78–85, 335/136, 137, 151–154, 196, 106, 89, 90, 91, 183, 184

[56] References Cited

U.S. PATENT DOCUMENTS 3,775,712 11/1973 Launt ..... 335/183

*Primary Examiner*—Harold Broome

*Attorney, Agent, or Firm*—Lackenbach, Lilling & Siegel

[57] ABSTRACT

An electromagnetic switching device includes a magnetic circuit having at least two open side legs, each carrying a control winding, said magnetic circuit being made of such a shape that when a signal is applied to one of the control windings, magnetic fluxes are produced in the open side legs, their direction being reversed when a signal is applied to the other control winding. Said electromagnetic switching device also includes at least one magnetically responsive contact featuring at least three contact members or at least two magnetically responsive contacts each featuring at least two contact members, each of the open side legs with a control winding being mounted thereon one contact member of at least one of the magnetically responsive contacts.

5 Claims, 3 Drawing Figures

ELECTROMAGNETIC SWITCHING DEVICE

This invention relates to switching devices and, in particular, to electromagnetic switching devices and can be employed in automatic control systems, monitoring systems, computers and those fields of technology, where highspeed bistable switching devices are required.

The progress of sample control systems, measuring systems, automatic monitoring systems, communications systems and computers initiated the wide use of various switching devices.

Modern switching devices should possess high speed of operation, high electrical conduction in the switched-on state and high electrical resistance in the switched-off state, adequate radiation stability, and current overload and mechanical acceleration stability. Absence of energy consumption from the power source in the switched-on state of a switching member is of particular importance. The demand has grown lately for various sequences of contact switching with control signals being applied through one or two control circuits. Bistable devices are in special demand.

There is known an electrically controlled switching device comprising a magnetic circuit having two plates and four connecting elements and carrying two control coils and two magnetically responsive contacts. When one of the control coils is energized or when said coils are energized by signals of opposite polarity, the contacts stay open. The contacts are closed only when both coils are energized by signals of like polarity.

There is also known an electromagnetic switch device having a magnetically responsive contact with al least two contact members.

These contacts are switched on or off in accordance with the attractive or repelling forces the between magnetic poles of the magnetic circuit. Both the closed and opened conditions of the contacts are self-held owing to the residual flux density.

There is known an electromagnetic switching device with a magnetic circuit made in a U-shape from a magnetic material possessing residual flux density. The magnetic circuit carries two perpendicular control windings and one or several magnetically responsive contacts positioned parallel to the connecting leg of the magnetic circuit. Depending on the control winding, when a signal is applied, contact members of the magnetically responsive contacts are switched-on or switched-off.

All the aforementioned devices have but one memory condition and cannot switch on some magnetically responsive contacts and at the same time switch out others, when signals are fed to the control windings alternately.

An object of this invention is to provide a high-speed bistable electromagnetic switching device having a nondestructive memory when the control signal is switched off.

This is achieved an electromagnetic switching device comprising a magnetic circuit carrying having two control windings and at least one magnetically responsive contact featuring contact members and being controlled by magnetic fluxes initiated in the magnetic circuit when signals are applied to the control windings. The magnetic circuit has, according to the invention, at least two open side legs, each having mounted thereon a control winding and being made of such a shape that when a signal is applied to one of the control windings, magnetic fluxes are initiated in the open side legs and reversed, when a signal is applied to the other control winding. Said device comprising at least one magnetically responsive contact with at least three contact members or at least two magnetically responsive contacts with at least two contact members, each of the open side legs with a control winding having mounted thereon a contact member of at least one magnetically responsive contact.

One specific embodiment of the invention employs a S-shaped magnetic circuit and two magnetically responsive contacts, each having two contact members, placed on the magnetic circuit so that one of the contact members of each magnetically responsive contact is secured on the open side leg of the magnetic circuit, whereas the other contact member is secured on the nearest end of the common leg of the magnetic circuit.

Another embodiment of the invention employs an E-shaped magnetic circuit, wherein a magnetically responsive contact has two side contact members, and one center contact member the side contact members being placed on the open side legs of the magnetic circuit and the center contact member being placed on a middle leg of the magnetic circuit.

It is advisable that in another embodiment of the device, the magnetic circuit is H-shaped and the control windings are placed on parallel open legs positioned on both sides of the common leg of the magnetic circuit and said common leg of the magnetic circuit has three magnetically responsive contacts positioned on its both sides, each of said contacts having two contact members, each open side leg having mounted thereon on both sides of the common leg of the magnetic circuit one contact member of each of the three magnetically responsive contacts, the adjacent open leg having mounted thereon respectively the other contact members of the same three magnetically responsive contacts.

The proposed device is a high-speed device possessing a nondestructive memory with the control signal switched off, high interference immunity, radiation stability and resistance to short current overloads. The device has high electrical conduction in a switched-on state and high electrical resistance in a switched-off state.

Other objects and advantages of the invention may be gained from the following detailed description of specific embodiments thereof taken in conjunction with the accompanying drawings, wherein.

Figure 1:
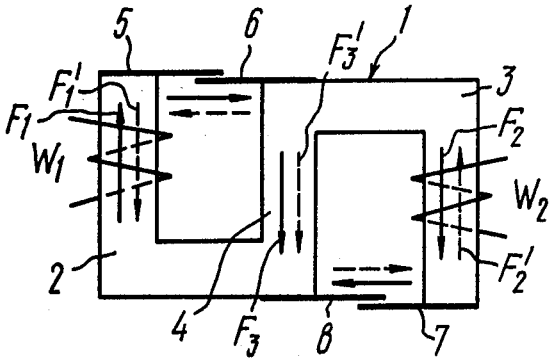
FIG. 1 is a schematic drawing of an electromagnetic switching device featuring an S-shaped magnetic circuit, according to the invention.

An electromagnetic switching device featuring an S-shaped magnetic circuit 1 (FIG. 1) comprises open side legs 2 and 3, a center leg 4, a magnetically responsive contact with contact members 5 and 6 and a magnetically responsive contact with contact members 7 and 8. The contact member 5 is placed on the open side leg 2, the contact member 6 is placed on the nearest end of the center leg 4, the contact member 7 is placed on the open side leg 3, and the contact member 8 is placed on the nearest end of the center leg 4. The side leg 2 has a control winding $W_I$ and the side leg 3 has a control winding $W_2$.

Figure 2:
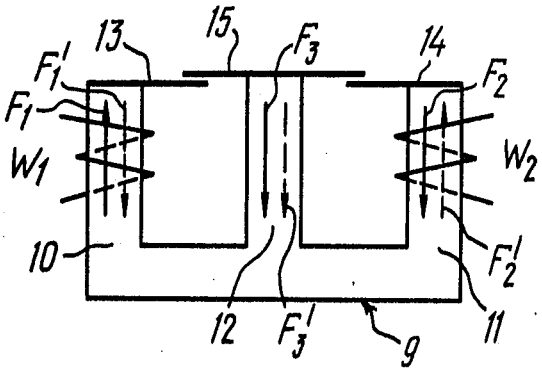
FIG. 2 is a schematic drawing of an electromagnetic switching device featuring an E-shaped magnetic circuit, according to the invention.

An electromagnetic switching device featuring an E-shaped magnetic circuit 9 (FIG. 2) comprises open side legs 10 and 11, a center leg 12 and a magnetically responsive contact with contact members 13 and 14 and a center contact member 15. The contact member 13 is placed on the open side leg 10, the contact ember 14 is placed on the open side leg 11, and the contact member 15 is placed on the center leg 12. The side leg 10 has a control winding $W_I$ and the side leg 11 has a control winding $W_2$.

Figure 3:
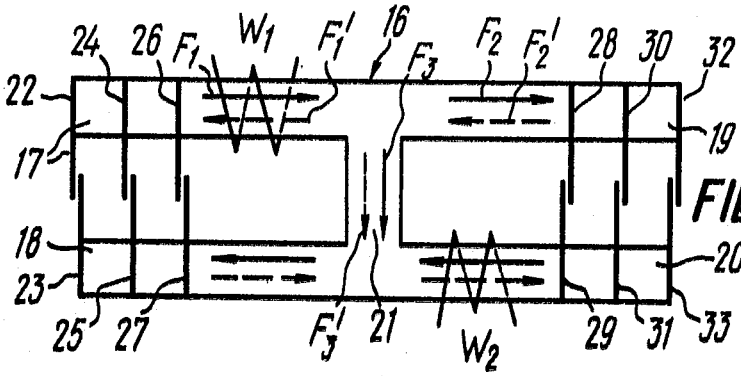
FIG. 3 is a schematic drawing of an electromagnetic switching device featuring an H-shaped magnetic circuit, according to the invention.

An electromagnetic switching device featuring an H-shaped magnetic circuit 16 (FIG. 3) comprises side legs 17, 18, 19, 20, a center leg 21 and six magnetically responsive contacts, each being supplied with two contact members 22 and 23, 24 and 25, 26 and 27, 28 and 29, 30 and 31, 32 and 33 respectively. The contact members 22, 24 and 26 are placed on the leg 17, the contact members 23, 25 and 27 are placed on the leg 18, the contact members 28, 30 and 32 are placed on the leg 19, and the contact members 29, 31 and 33 are placed on the leg 20. The open leg 17 has a control winding $W_I$, and the leg 20 positioned on the other side of the axis of the center leg 21 has a winding $W_2$.

The device operates as follows.

In a device featuring an S-shaped magnetic circuit 1 (FIG. 1) control signals are alternately applied to the windings $W_1$ and $W_2$. The first control signal applied to the winding $W_1$ initiates a magnetic flux $F_1$, indicated by an arrow in the side leg 2, its ramifications $F_2$ and $F_3$ in the side leg 3 and the center leg 4 are also indicated by arrows. The side leg 2 is magnetized under the influence of the flux $F_1$ and makes the contact members 5 and 6 close. The side leg 3 is insufficiently magnetized by the flux $F_2$ to make the contact members 7 and 8 close and they stay open. A second control signal fed to the winding $W_2$ initiates a magnetic flux $F_2$; indicated by a dashed arrow in the side leg 3, its ramifications $F_1'$ and $F_3'$ in the side leg 2 and the center leg 4 are also indicated by dashed arrows. The side leg 3 is remagnetized under the influence of the flux $F_2'$ and makes the contact members 7 and 8 close. The side leg 2 is demagnetized by the flux $F_1'$ and the contact members 5 and 6 open. The processes are repeated afterwards. Thus, uneven control signals connect the contact members 5 and 6 and disconnect the contact members 7 and 8, whereas the even signals connect the contact members 7 and 8 and disconnect the contact members 5 and 6.

In a device featuring an E-shaped magnetic circuit 9 (FIG. 2) control signals are fed alternately to the windings $W_1$ and $W_2$. The first control signal fed to the winding $W_1$ produces a magnetic flux $F_1$ indicated by an arrow in the side leg 10, its ramifications $F_2$ and $F_3$ in the side leg 11 and the center leg 12 are also indicated by arrows. The side leg 10 is magnetized under the influence of the flux $F_1$ and makes the contact members 13 and 15 close. The side leg 11 is insufficiently magnetized by the flux $F_2$ to close the contact members 14 and 15 and they stay open.

A second control signal fed to the winding $W_2$ produces a magnetic flux $F_2'$ indicated by a dashed arrow in the side leg 11, its ramifications $F_1'$ and $F_3'$ in the side leg 10 and the center leg 12 are also indicated by dashed arrows. The side leg 11 is remagnetized under the influence of the flux $F_2'$ and makes the contact members 14 and 15 close. The side leg 10 is demagnetized by the flux $F_I'$ and the contact members 13 and 15 are disconnected. Further on, as signals are fed to the windings $W_I$ and $W_2$, the processes are repeated. As a result, uneven control signals connect the contact members 13 and 15 and disconnect the contact members 14 and 15, whereas even control signals connect the contact members 14 and 15 and disconnect the contact members 13 and 15.

In a device featuring an H-shaped magnetic circuit 16 (FIG. 3) control signals are fed alternately to the windings $W_1$ and $W_2$. The first control signal fed to the winding $W_1$, produces a magnetic flux $F_1$ indicated by an arrow in the side legs 17 and 18, its ramifications $F_2$ and $F_3$ in the side legs 19 and 20 and in the center leg 21 are also indicated by arrows. The side legs 17 and 18 are magnetized under the influence of the flux $F_1$, and make the contact members 22 and 23, 24 and 25, 26 and 27 close. The side legs 19 and 20 are insufficiently magnetized by the magnetic flux $F_2$ to close the contact members 28 and 29, 30 amd 31, 32 and 33 and they stay disconnected.

The second control signal fed to the winding $W_2$ produces a magnetic flux $F_2'$ indicated by a dashed arrow in the side legs 19 and 20, its ramifications $F_1'$ and $F_3'$ in the side legs 17 and 18 and in the center leg 21 are also indicated by dashed arrows. The side legs 19 and 20 are remagnetized under the influence of the flux $F_2'$ and make the contact members 28 and 29, 30 and 31, 32 and 33 close. The side legs 17 and 18 are demagnetized by the flux $F_1'$ and the contact members 22 and 23, 24 and 25, 26 and 27 are disconnected. The processes are then repeated. As a result, uneven control signals connect the contact emembers 22 and 23, 24 and 25, 26 and 27 and disconnect the contact members 28 and 29, 30 and 31, 32 and 33, whereas even signals connect the contact members 28 and 29, 30 and 31, 32 and 33 and disconnect the contact members 22 and 23, 24 and 25, 26 and 27.

The proposed device operates from signals about a microsecond long, ensures a great number of switchings, posesses high sensitivity, and is small and light.

What is claimed is:

1. An electromagnetic switching device comprising: a magnetic circuit having a center and at least two open side legs; two control windings, one of said windings being placed on each of said open side legs; at least two magnetically responsive contacts, each contact having at least two contact members, one of said contact members of at least one of said magnetically responsive contacts being placed on each of said open legs; said magnetic circuit having a shape that when a first control signal is fed to one of said control windings a larger magnetic flux is produced in the side leg with an energized winding, said larger flux switching the closest magnetically responsive contact, and a lesser magnetic flux in the side leg with a de-energized winding, said lesser magnetic flux switching off the closest contact, said magnetic fluxes being reversed when a second control signal of opposite polarity is fed to the other of said control windings.

2. A device as claimed in claim 1, wherein said magnetic circuit is S-shaped and wherein one of said contact members of each of said magnetically responsive contacts is placed on one of said open side legs and the other of said contact members of each of said contacts is placed on the nearest end of a center leg of said magnetic circuit.

3. A device as claimed in claim 1, wherein said magnetic circuit is H-shaped and said control windings are mounted on parallel open legs positioned on opposite sides of the axis of a center leg, three of said magnetically responsive contacts being placed on each side of the axis of said center leg, each of said contacts having two contact members, one of said contact members of each of said contacts being mounted on one of said open legs and the other of said contact members of said contact being mounted on a parallel open leg on the same side of the axis of said center leg.

4. An electromagnetic switching device comprising: a magnetic circuit having a center and at least two open side legs; a control winding positioned on each of said open side legs; at least one magnetically responsive contact with at least three contact members, one of said contact members of said magnetically responsive contact being placed on each of said open side legs; said magnetic circuit having shape that when a first control signal is fed to one of said control windings a larger magnetic flux is produced in the side leg with an energized winding, said larger flux switching the closest magnetically responsive contact, and a lesser magnetic flux in the side leg with a de-energized winding, said lesser magnetic flux switching off the closest contact, said fluxes being reversed when a second control signal of opposite polarity is fed to the other of said control windings.

5. A device as claimed in claim 4, wherein said magnetic circuit is E-shaped and said magnetically responsive contact has two side contact members and one center contact member, said side contact members being placed on said open side legs and said center contact member being placed on the center leg of said magnetic circuit.

* * * * *